US010131368B2

(12) United States Patent
Nakao et al.

(10) Patent No.: US 10,131,368 B2
(45) Date of Patent: Nov. 20, 2018

(54) STEERING BOGIE FOR RAILCAR

(71) Applicant: KAWASAKI JUKOGYO KABUSHIKI KAISHA, Kobe-shi, Hyogo (JP)

(72) Inventors: Shunichi Nakao, Kobe (JP); Takeyoshi Kusunoki, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 0 days.

(21) Appl. No.: 15/537,690

(22) PCT Filed: Dec. 9, 2015

(86) PCT No.: PCT/JP2015/006133
§ 371 (c)(1),
(2) Date: Jun. 19, 2017

(87) PCT Pub. No.: WO2016/098316
PCT Pub. Date: Jun. 23, 2016

(65) Prior Publication Data

US 2017/0341663 A1 Nov. 30, 2017

(30) Foreign Application Priority Data

Dec. 17, 2014 (JP) ..... 2014-254688

(51) Int. Cl.
*B61F 5/38* (2006.01)
*B61F 3/08* (2006.01)

(52) U.S. Cl.
CPC ..... *B61F 5/38* (2013.01); *B61F 3/08* (2013.01); *B61F 5/386* (2013.01)

(58) Field of Classification Search
CPC .. B61F 5/38; B61F 5/383; B61F 5/386; B61F 5/40; B61F 5/42; B61F 5/44; B61F 5/46; B61F 5/48; B61F 3/08
(Continued)

(56) References Cited

U.S. PATENT DOCUMENTS 4,519,329 A * 5/1985 Vacher ..... B61F 5/383 105/168
4,640,198 A 2/1987 Haupl
4,742,779 A * 5/1988 Bevand ..... B61F 3/04 105/167

FOREIGN PATENT DOCUMENTS

EP 0365489 A2 4/1990
JP H06-087446 A 3/1994
(Continued)

OTHER PUBLICATIONS

Mar. 8, 2016 International Search Report issued in International Patent Application No. PCT/JP2015/006133.
(Continued)

*Primary Examiner* — Mark T Le
(74) *Attorney, Agent, or Firm* — Oliff PLC

(57) ABSTRACT

A steering bogie for a railcar includes: a bogie frame supporting a carbody of the railcar; a wheelset including an axle and wheels, the axle extending in a car width direction, the wheels being provided at both respective sides of the axle; and a steering device that presses a pressing target member to steer the wheelset with respect to the bogie frame, the pressing target member being constituted by the wheelset or a member configured to be displaced integrally with the wheelset in a steering direction, the steering device including at least one steering unit, the at least one steering unit including a pressing member that separably contacts the pressing target member to press the pressing target member, and a power mechanism causes the pressing member to contact and separate from the pressing target member.

13 Claims, 6 Drawing Sheets

(58) Field of Classification Search
USPC ..... 105/163.1, 163.2, 168
See application file for complete search history.

(56) References Cited

FOREIGN PATENT DOCUMENTS

| | | | |
|---|---|---|---|
| JP | H09-226576 | A | 9/1997 |
| JP | H11-208470 | A | 8/1999 |
| JP | 2003-54404 | A | 2/2003 |
| JP | 2006/282060 | A | 10/2006 |
| JP | 2007-216876 | A | 8/2007 |
| JP | 2013-23094 | A | 2/2013 |

OTHER PUBLICATIONS

Sep. 27, 2017 Office Action issued in Chinese Patent Application No. 201580065126.X.

* cited by examiner

STEERING BOGIE FOR RAILCAR

TECHNICAL FIELD

The present invention relates to a steering bogie for a railcar, the steering bogie including a steering device configured to steer a wheelset with respect to a bogie frame.

BACKGROUND ART

To improve a curved line passing performance of a railcar, a steering bogie has been proposed, the steering bogie performing forced steering in accordance with a curvature of a curved track by a steering mechanism including an actuator. For example, a bogie of PTL 1 forcedly steers a wheelset supported by an axle box in such a manner that: one end portion of an actuator is coupled to a bogie frame; the other end portion of the actuator is coupled to the axle box; and the actuator is expanded and contracted by oil pressure. Also known is a steering bogie in which: a steering link is coupled to a bolster (or a carbody) and an axle box; and steering is passively performed in accordance with a curvature of a curved track. For example, according to a bogie of PTL 2, a steering link mechanically operates in conjunction with turning of a bolster with respect to a bogie frame in a yawing direction when a railcar passes through a curved line. With this, an axle box is moved in a car longitudinal direction, and a wheelset is steered.

CITATION LIST

Patent Literature

PTL 1: Japanese Laid-Open Patent Application Publication No. 9-226576

PTL 2: Japanese Laid-Open Patent Application Publication No. 2013-23094

SUMMARY OF INVENTION

Technical Problem

In the steering bogie of PTL 1, the other end portion of the actuator is coupled to the axle box. Therefore, if the actuator breaks and sticks, the broken actuator inhibits movements of the wheelset in a steering direction. Further, in the steering bogie of PTL 2, if the steering link breaks, the steering link may inhibit the movements of the wheelset in the steering direction. As above, if a power mechanism of the steering device has any trouble, it becomes difficult for the wheelset to be naturally steered by lateral force applied from rails when the steering bogie passes through a curved line. Thus, the lateral force applied to a wheel from the rail increases. Therefore, a flange of the wheel tends to wear, and squeaking noise may be generated by friction between the wheel and the rail.

An object of the present invention is to satisfactorily maintain a bogie performance even when a power mechanism of a steering device has a trouble or the like.

Solution to Problem

A steering bogie for a railcar according to one aspect of the present invention includes: a bogie frame supporting a carbody of the railcar; a wheelset including an axle and wheels, the axle extending in a car width direction, the wheels being provided at both respective sides of the axle; and a steering device that presses a pressing target member to steer the wheelset with respect to the bogie frame, the pressing target member being constituted by the wheelset or a member configured to be displaced integrally with the wheelset in a steering direction, the steering device including at least one steering unit, the at least one steering unit including a pressing member that separably contacts the pressing target member to press the pressing target member, and a power mechanism that causes the pressing member to contact and separate from the pressing target member.

According to the above configuration, when the pressing member presses the pressing target member by the power mechanism, the wheelset is actively steered. In contrast, when it is unnecessary to steer the wheelset, the pressing member is separated from the pressing target member by the power mechanism. Therefore, even if the power mechanism has a trouble or the like in a state where the pressing member is separated from the pressing target member, the pressing member does not restrict the movement of the wheelset, and the movement of the wheelset in the steering direction is allowed. Therefore, even if the power mechanism has a trouble or the like, the wheelset can be steered along the rails within a range of a natural phenomenon caused by lateral force applied from the rails when the railcar passes through a curved line. On this account, a bogie performance when the power mechanism of the steering device has a trouble or the like can be satisfactorily maintained.

Advantageous Effects of Invention

As is clear from the above explanations, the present invention can satisfactorily maintain the bogie performance even when the power mechanism of the steering device has a trouble or the like.

DESCRIPTION OF EMBODIMENTS

Figure 1:
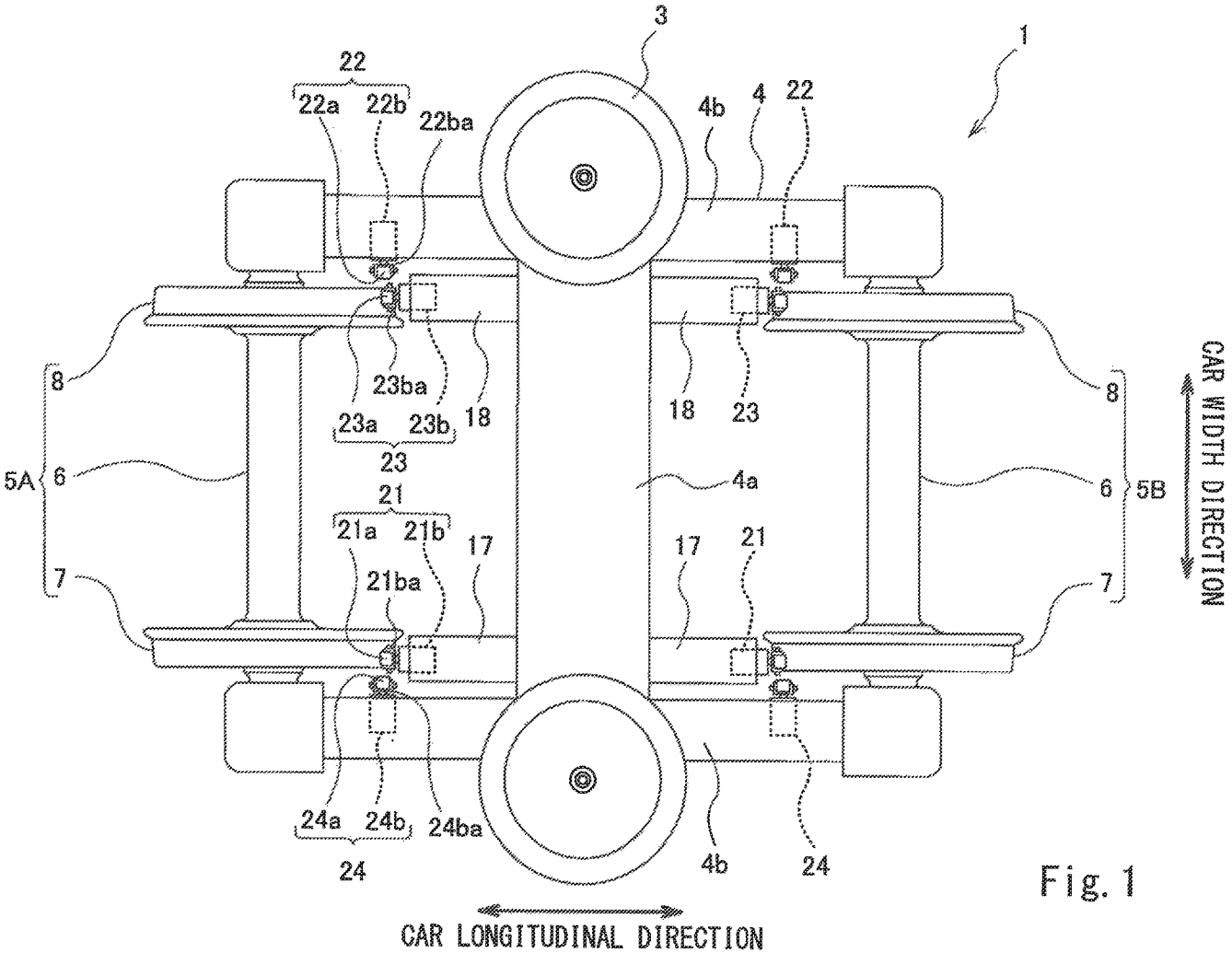
FIG. 1 is a plan view showing a steering bogie for a railcar according to Embodiment 1.

Hereinafter, embodiments will be explained in reference to the drawings. In the following explanation, a direction in which a railcar travels, that is, a length direction in which a carbody extends is defined as a car longitudinal direction, and a crosswise direction orthogonal to the car longitudinal direction is defined as a car width direction (It should be noted that in the embodiments, the car longitudinal direction may also be referred to as a forward/rearward direction, and the car width direction may also be referred to as a leftward/rightward direction.). Further, in the drawings, the same reference signs are used for the same components.

Embodiment 1

Figure 2:
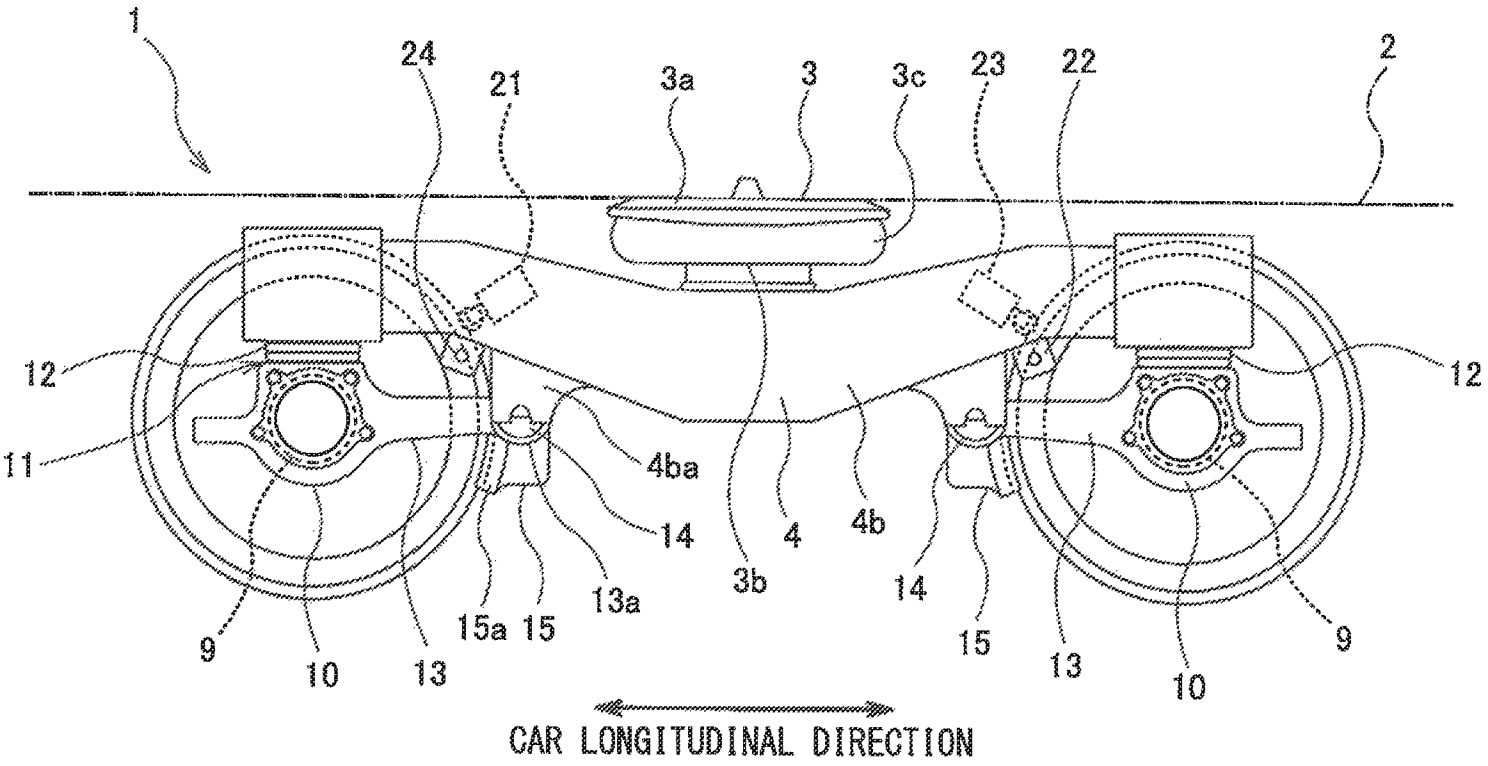
FIG. 2 is a side view showing the steering bogie of FIG. 1.

FIG. 1 is a plan view showing a steering bogie 1 for a railcar according to Embodiment 1. FIG. 2 is a side view showing the steering bogie 1 of FIG. 1. As shown in FIGS. 1 and 2, the steering bogie 1 of Embodiment 1 includes a bogie frame 4 supporting a carbody 2 of the railcar through air springs 3. Each of the air springs 3 includes: an upper wall portion 3*a* connected to the carbody 2; a lower wall portion 3*b* connected to the bogie frame 4; and an elastic portion 3*c* elastically coupling the upper wall portion 3*a* and the lower wall portion 3*b*. The air spring 3 is configured such that the upper wall portion 3*a* and the lower wall portion 3*b* are relatively displaceable in a horizontal direction through the elastic portion 3*c*. With this, the carbody 2 and the bogie frame 4 are relatively displaceable in a yawing direction.

The bogie frame 4 includes: a cross beam 4*a* extending in the car width direction, a pair of air springs 3 being mounted on the cross beam 4*a*; and a pair of side sills 4*b* connected to both respective car width direction end portions of the cross beam 4*a* and extending in the car longitudinal direction. The bogie frame 4 has an H shape in a plan view. A wheelset 5A extending in the car width direction is arranged in front of the cross beam 4*a*, and a wheelset 5B extending in the car width direction is arranged behind the cross beam 4*a*. Each of the wheelsets 5A and 5B includes: an axle 6 extending in the car width direction; and first and second wheels 7 and 8 provided at both respective left and right sides of the axle 6. Hereinafter, for convenience of explanation, a car proceeding direction is determined as one direction. Then, the wheelset 5A is regarded as a front-wheel wheelset, and the wheelset 5B is regarded as a rear-wheel wheelset.

Bearings 9 rotatably supporting the axle 6 are provided at both respective car width direction end portions of the axle 6 so as to be located outside the first and second wheels 7 and 8 in the car width direction. The bearings 9 are accommodated in respective axle boxes 10. Each of the axle boxes 10 is elastically coupled to and suspended from the side sill 4*b* by an axle box suspension 11 (suspension). The axle box suspension 11 includes: a coil spring 12 (axle spring) interposed between the axle box 10 and the side sill 4*b* and configured to expand and contract in a vertical direction; and an axle beam 13 integrally extending from the axle box 10 toward a middle side in the car longitudinal direction and turnably coupled to the side sill 4*b*. The axle box suspension 11 is a so-called axle beam-type suspension.

A tip end portion 13*a* of the axle beam 13 is coupled to a bracket portion 4*ba* of the side sill 4*b* through a rubber bushing 14. Displacement of the axle beam 13 relative to the side sill 4*b* in the yawing direction is allowed by elastic deformation of the rubber bushing 14. To be specific, the displacement of the axle box 10 and the wheelset 5 relative to the bogie frame 4 in the yawing direction is allowed, the axle box 10 and the wheelset 5 being members displaced in the yawing direction integrally with the axle beam 13. Brake devices 15 including respective brake shoes 15*a* that can be pressed against wheel treads of the first and second wheels 7 and 8 are mounted on the bogie frame 4.

A steering device 16 configured to press the first and second wheels 7 and 8 (pressing target member) to steer a pair of wheelsets 5A and 5B with respect to the bogie frame 4 is mounted on the bogie frame 4. Each of the configuration and arrangement of the steering device 16 is symmetrical (line-symmetrical) with respect to the cross beam 4*a* in the car longitudinal direction. Therefore, the following will explain only one side of the steering device 16 in the car longitudinal direction, that is, components and the like for steering the front-wheel wheelset 5A.

The steering device 16 includes: first and second steering units 21 and 22 configured to steer the wheelset 5A in a first direction from a neutral position (non-turning position); and third and fourth steering units 23 and 24 configured to steer the wheelset 5A in a second direction from the neutral position (non-turning position). The first steering unit 21 includes: a first pressing member 21*a* configured to separably contact the first wheel 7 to press the first wheel 7; and a first hydraulic cylinder 21*b* (actuator; power mechanism) configured to drive the first pressing member 21*a* to cause the first pressing member 21*a* to contact and separate from the wheel 7. The second steering unit 22 includes: a second pressing member 22*a* configured to separably contact the second wheel 8 to press the second wheel 8; and a second hydraulic cylinder 22*b* (actuator; power mechanism) configured to drive the second pressing member 22*a* to cause the second pressing member 22*a* to contact and separate from the wheel 8. The third steering unit 23 includes: a third pressing member 23*a* configured to separably contact the second wheel 8 to press the second wheel 8; and a third hydraulic cylinder 23*b* (actuator; power mechanism) configured to drive the third pressing member 23*a* to cause the third pressing member 23*a* to contact and separate from the wheel 8. The fourth steering unit 24 includes: a fourth pressing member 24*a* configured to separably contact the first wheel 7 to press the first wheel 7; and a fourth hydraulic cylinder 24*b* (actuator; power mechanism) configured to drive the fourth pressing member 24*a* to cause the fourth pressing member 24*a* to contact and separate from the wheel 7.

The first to fourth hydraulic cylinders 21*b* to 24*b* include rods 21*ba* to 24*ba*, respectively. The rods 21*ba* to 24*ba* reciprocate by oil pressure. The first to fourth pressing members 21*a* to 24*a* are rollers rotatably supported by the rods 21*ba* to 24*ba*, respectively. When each of the first to fourth pressing members 21*a* to 24*a* contacts the wheel 7 or 8, it rotates in accordance with the rotation of the wheel 7 or 8. The first to fourth pressing members 21*a* to 24*a* are formed by a low friction material that is lower in friction coefficient than a material of a sliding surface of the brake shoe 15*a* of the brake device 15. As above, the first to fourth steering units 21 to 24 are the same in configuration as one another.

The first steering unit 21 is arranged so as to face the wheel tread (first portion) of the first wheel 7 from the middle side in the car longitudinal direction. The first hydraulic cylinder 21*b* is fixed to the bogie frame 4 through a bracket 17. The rod 21*ba* of the first hydraulic cylinder 21*b* expands and contracts in the car longitudinal direction. When the rod 21*ba* of the first hydraulic cylinder 21*b* is located at a most contracted position, the first pressing member 21*a* is separated from the wheel tread of the first wheel 7 on a minimum curved line of rails during traveling. When the rod 21*ba* of the first hydraulic cylinder 21*b* expands, the first pressing member 21*a* presses the wheel tread of the first wheel 7 outward in the car longitudinal direction to displace the first wheel 7.

The second steering unit 22 is arranged so as to face a portion (second portion) of an outer side surface of the second wheel 8 from an outer side in the car width direction, the second portion being located at the middle side in the car longitudinal direction. The second hydraulic cylinder 22*b* is fixed to the bogie frame 4 (side sill 4*b*). The rod 22*ba* of the second hydraulic cylinder 22*b* expands and contracts in the car width direction. When the rod 22*ba* of the second hydraulic cylinder 22*b* is located at a most contracted position, the second pressing member 22*a* is separated from the outer side surface of the second wheel 8 on the minimum curved line of the rails during traveling. When the rod 22*ba* of the second hydraulic cylinder 22*b* expands, the second pressing member 22*a* presses a region of the outer side surface of the second wheel 8 inward in the car width direction to displace the second wheel 8, the region being located at the middle side in the car longitudinal direction.

As above, when the rods 21*ba* and 22*ba* of the first and second hydraulic cylinders 21*b* and 22*b* expand, and the first and second pressing members 21*a* and 22*a* push the first and second wheels 7 and 8, respectively, the wheelset 5 is forcedly steered in the first direction from the neutral position. To be specific, since the first steering unit 21 and the second steering unit 22 press the wheelset 5 in different directions (in the present embodiment, directions orthogonal to each other), the wheelset 5A is smoothly steered in the first direction.

The third steering unit 23 is arranged symmetrically with respect to the first steering unit 21 in the car width direction, and the fourth steering unit 24 is arranged symmetrically with respect to the second steering unit 22 in the car width direction. The third steering unit 23 is arranged so as to face the wheel tread of the second wheel 8 from the middle side in the car longitudinal direction. The third hydraulic cylinder 23*b* is fixed to the bogie frame 4 through a bracket 18. The rod 23*ba* of the third hydraulic cylinder 23*b* expands and contracts in the car longitudinal direction. When the rod 23*ba* of the third hydraulic cylinder 23*b* is located at a most contracted position, the third pressing member 23*a* is separated from the wheel tread of the second wheel 8 on the minimum curved line of the rails during traveling. When the rod 23*ba* of the third hydraulic cylinder 23*b* expands, the third pressing member 23*a* pushes the wheel tread of the second wheel 8 outward in the car longitudinal direction to displace the second wheel 8.

The fourth steering unit 24 is arranged so as to face a portion of an outer side surface of the first wheel 7 from the outer side in the car width direction, the portion being located at the middle side in the car longitudinal direction. The fourth hydraulic cylinder 24*b* is fixed to the bogie frame 4 (side sill 4*b*). The rod 24*ba* of the fourth hydraulic cylinder 24*b* expands and contracts in the car width direction. When the rod 24*ba* of the fourth hydraulic cylinder 24*b* is located at a most contracted position, the fourth pressing member 24*a* is separated from the outer side surface of the first wheel 7 on the minimum curved line (minimum curvature) of the rails during traveling. When the rod 24*ba* of the fourth hydraulic cylinder 24*b* expands, the fourth pressing member 24*a* pushes a region of the outer side surface of the first wheel 7 inward in the car width direction to displace the first wheel 7, the region being located at the middle side in the car longitudinal direction.

As above, when the rods 23*ba* and 24*ba* of the third and fourth hydraulic cylinders 23*b* and 24*b* expand, and the third and fourth pressing members 23*a* and 24*a* push the second and first wheels 8 and 7, respectively, the wheelset 5A is forcedly steered in the second direction from the neutral position.

Figure 3:
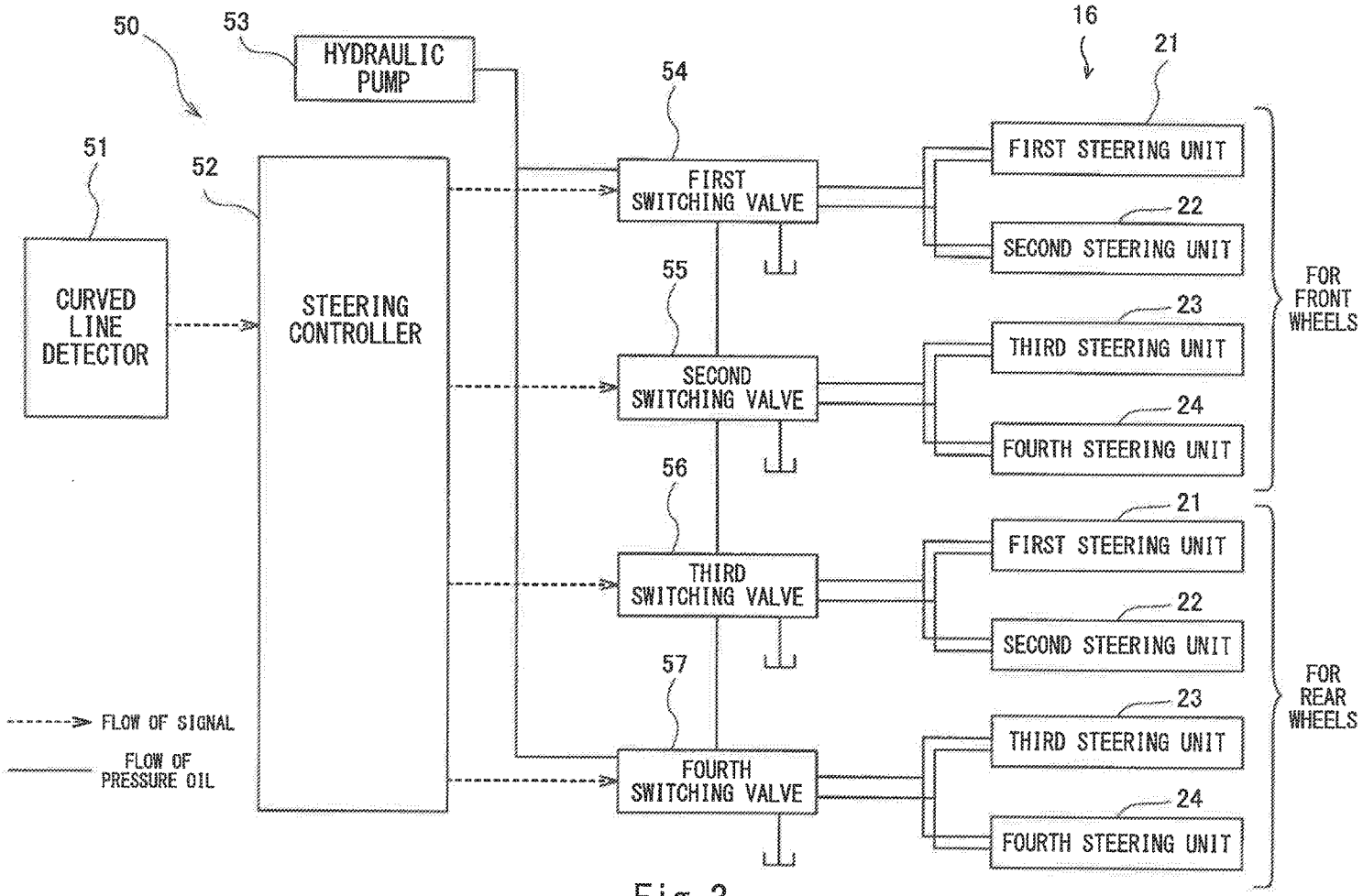
FIG. 3 is a block diagram showing a steering system for steering a wheelset of the steering bogie of FIG. 1.
Figure 4:
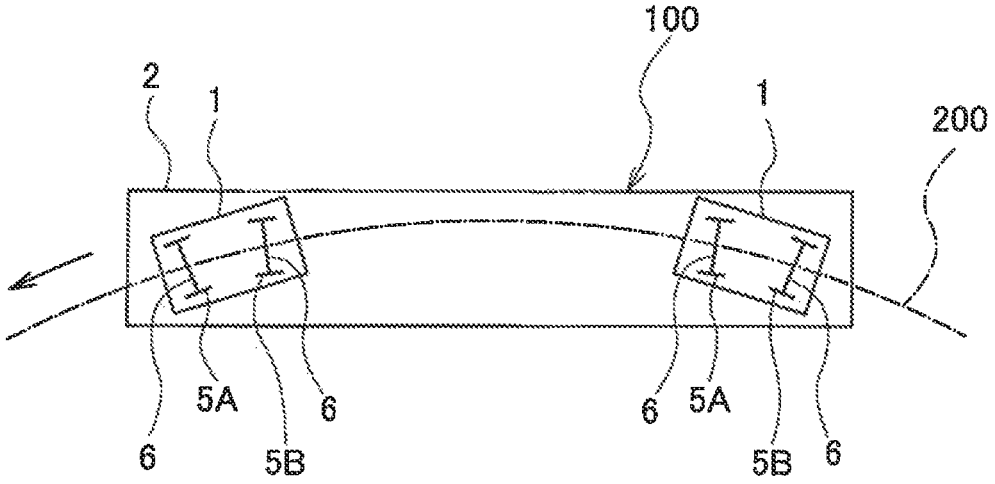
FIG. 4 is a schematic plan view for explaining a state where the railcar including the steering bogie of FIG. 1 passes through a curved line.

FIG. 3 is a block diagram showing a steering system 50 configured to steer the wheelsets 5A and 5B of the steering bogie 1 of FIG. 1. FIG. 4 is a schematic plan view for explaining a state where a railcar 100 including the steering bogie 1 of FIG. 1 passes through a curved line. It should be noted that FIG. 4 shows a track line 200 indicating a center line extending between a pair of rails (not shown). As shown in FIG. 3, the steering system 50 includes: a curved line detector 51; a steering controller 52; a hydraulic pump 53; first to fourth switching valves 54 to 57; the first to fourth steering units 21 to 24 for the front wheels; and the first to fourth steering units 21 to 24 for the rear wheels. The steering system 50 is mounted on the bogie 1 and the carbody 2. For example, the curved line detector 51, the steering controller 52, the hydraulic pump 53, and the first to fourth switching valves 54 to 57 are mounted on the carbody 2, and the first to fourth steering units 21 to 24 for the front and rear wheels are mounted on the bogie 1.

The curved line detector 51 is a known device configured to detect passing of the railcar through a curved line region of the rails while the railcar is traveling and the curvature of the curved line. For example, the curved line detector 51 may include: a curved line map that records information about the position and curvature of the curved line region of the rails; and a railcar own position detector configured to be able to detect an own position of the railcar based on, for example, an accumulated traveling distance calculated in accordance with the information from the speed generator. The curved line detector 51 may be configured to detect the passing through the curved line region of the rails and the curvature of the curved line by collating the detected own position with the curved line map.

Based on the information detected by the curved line detector 51, the steering controller 52 controls the first to fourth switching valves 54 to 57 so as to selectively drive a group of the first and second steering units 21 and 22 or a group of the third and fourth steering units. The hydraulic pump 53 supplies the pressure oil to (the first to fourth hydraulic cylinders 21*b* to 24*b* of) the first to fourth steering units 21 to 24.

Each of the first and third switching valves 54 and 56 can switch channels by changing the position of a switching element (for example, a spool) in the valve to a first position where the rods 21*ba* and 22*ba* of the first and second hydraulic cylinders 21*b* and 22*b* of the first and second steering units 21 and 22 expand, a second position where the rods 21*ba* and 22*ba* of the first and second hydraulic cylinders 21*b* and 22*b* of the first and second steering units 21 and 22 contract, or a neutral position where the first and second hydraulic cylinders 21*b* and 22*b* stop.

Similarly, each of the second and fourth switching valves 55 and 57 can switch channels by changing the position of a switching element (for example, a spool) in the valve to a first position where the rods 23*ba* and 24*ba* of the third and fourth hydraulic cylinders 23*b* and 24*b* of the third and fourth steering units 23 and 24 expand, a second position where the rods 23*ba* and 24*ba* of the third and fourth hydraulic cylinders 23*b* and 24*b* of the third and fourth steering units 23 and 24 contract, or a neutral position where the third and fourth hydraulic cylinders 23*b* and 24*b* stop.

When the railcar travels linearly, the steering controller 52 maintains the first to fourth switching valves 54 to 57 at the neutral positions in a state where the first to fourth steering units 21 to 24 are separated from the wheelsets 5 (to be specific, in a state where the rods 21*ba* to 24*ba* of the first to fourth hydraulic cylinders 21*b* to 24*b* contract). When steering the wheelsets 5A and 5B in the first direction, the steering controller 52 switches the first and third switching valves 54 and 56 to the first positions to expand the rods 21*ba* and 22*ba* of the first and second hydraulic cylinders 21*b* and 22*b* while maintaining the second and fourth switching valves 55 and 57 at the neutral positions.

A displacement magnitude of the wheel 7 by pressing of the first pressing member 21*a* is determined based on a stroke amount of the expansion of the rod 21*ba*, and a displacement magnitude of the wheel 8 by pressing of the second pressing member 22*b* is determined based on a stroke amount of the expansion of the rod 22*ba*. Each of the stroke amount of the expansion of the rod 21*ba* and the stroke amount of the expansion of the rod 22*ba* is determined by a time from when the first or third switching valve 54 or 56 is switched to the first position until when the first or third switching valve 54 or 56 returns to the neutral position. One example is that in a case where the steering controller 52 returns the first switching valve 54 (or the third switching valve 56) to the neutral position when the displacement magnitudes of the wheels 7 and 8 detected by displacement detecting units (not shown) configured to detect the displacement magnitudes of the wheels 7 and 8 reach target values after the first switching valve 54 (or the third switching valve 56) is switched to the first position, the wheelset 5A (or the wheelset 5B) is maintained at a target steering angle. Each of the displacement detecting units may be a sensor configured to measure the displacement of a side surface of the wheel 7 or 8 without contact or may measure the stroke amounts of the rod 21*ba* or 22*ba* of the hydraulic cylinder 21*b* or 22*b*.

After that, to return the wheelsets 5A and 5B to the neutral positions, the steering controller 52 switches the first and third switching valves 54 and 56 to the second positions to contract the rods 21*ba* and 22*ba* of the first and second hydraulic cylinders 21*b* and 22*b* while maintaining the second and fourth switching valves 55 and 57 at the neutral positions. Then, when it is determined that the rods 21*ba* and 22*ba* have returned to the most retracting positions, the steering controller 52 returns the first and third switching valves 54 and 56 to the neutral positions. With this, the first and second pressing members 21*a* and 22*b* are maintained so as to be separated from the wheels 7 and 8.

When steering the wheelsets 5 in the second direction, control opposite to the above control is performed. To be specific, the steering controller 52 switches the second and fourth switching valves 55 and 57 to the first positions to expand the rods 23*ba* and 24*ba* of the third and fourth hydraulic cylinders 23*b* and 24*b* while maintaining the first and third switching valves 55 and 57 at the neutral positions. To return the wheelsets 5 to the neutral positions, the steering controller 52 switches the second and fourth switching valves 55 and 57 to the second positions to contract the rods 23*ba* and 24*ba* of the third and fourth hydraulic cylinders 23*b* and 24*b* while maintaining the first and third switching valves 54 and 56 at the neutral positions.

Operation ranges of the steering units 21 to 24 are adjusted such that the displacements of the wheelsets 5A and 5B are obtained in accordance with the curvature of the curved line during traveling. Maximum operation ranges of the steering units 21 to 24 are set such that proper displacements of the wheels 7 and 8 on the curved line during traveling are obtained.

When the railcar travels from a straight line region of the rails to the curved line region, the front-wheel wheelset 5A first enters into the curved line region, and the rear-wheel wheelset 5B then enters into the curved line region. Therefore, the steering controller 52 may perform such a control operation that a steering start timing of the rear-wheel wheelset 5B is delayed from a steering start timing of the front-wheel wheelset 5A. Specifically, the steering controller 52 may calculate a time difference between a timing at which the front-wheel wheelset 5A starts entering into the curved line region and a timing at which the rear-wheel wheelset 5B starts entering into the curved line region and delay the steering start timing of the rear-wheel wheelset 5B by the time difference. It should be noted that the steering start timing of the front-wheel wheelset 5A and the steering start timing of the rear-wheel wheelset 5B may be the same as each other. In this case, the wheelset 5B is steered along the rails within a range of a natural phenomenon caused by lateral force applied from the rails when the railcar passes through the curved line.

As above, as shown in FIG. 4, in the railcar 100 passing through the curved line, the steering system 50 performs steering such that the axle 6 faces in a direction substantially orthogonal to the track line 200. With this, the lateral force applied from the rails to the wheels 7 and 8 is reduced.

According to the above-explained configuration, the wheelset 5 is forcedly steered in the first direction in such a manner that the first and second pressing members 21*a* and 22*a* press the first and second wheels 7 and 8 by the power of the first and second hydraulic cylinders 21*b* and 22*b*, respectively, and the wheelset 5 is forcedly steered in the second direction in such a manner that the third and fourth pressing members 23*a* and 24*a* press the second and first wheels 8 and 7 by the power of the third and fourth hydraulic cylinders 23*b* and 24*b*, respectively. When it is unnecessary to steer the wheelsets 5, the first to fourth pressing members 21*a* to 24*a* are separated from the first and second wheels 7 and 8 by the first to fourth hydraulic cylinders 21*b* to 24*b*. Therefore, even if any of the first to fourth hydraulic cylinders 21*b* to 24*b* has a trouble or the like in a state where the first to fourth pressing members 21*a* to 24*a* are separated from the first and second wheels 7 and 8, the first to fourth pressing members 21*a* to 24*a* do not restrict the movements of the wheelsets 5, and the movements of the wheelsets 5 in the steering direction are allowed.

Therefore, even if any of the first to fourth hydraulic cylinders 21*b* to 24*b* has a trouble or the like, the wheelsets 5 can be steered along the rails within the range of the natural phenomenon caused by the lateral force applied from the rails when the railcar passes through the curved line. On this account, the bogie performance when any of the first to fourth hydraulic cylinders 21*b* to 24*b* of the steering device 16 has a trouble or the like can be satisfactorily maintained.

Further, it is unnecessary to couple each of the first to fourth steering units 21 to 24 to the pressing target member constituted by the wheelset 5A or the pressing target member constituted by a member (the axle box 10, the axle beam 13, or the like) configured to be displaced integrally with the wheelset 5B in the steering direction. Therefore, the first to fourth steering units 21 to 24 can be easily added to existing bogies. Further, the first to fourth pressing members 21*a* to 24*a* are rollers and rotate together with the wheels 7 and 8 when they contact the wheels 7 and 8. Therefore, the wear of the first to fourth pressing members 21*a* to 24*a* can be suppressed, and the decreases in speed of the wheels 7 and 8 by pressing of the first to fourth pressing members 21*a* to 24*a* can be suppressed. Further, since the first to fourth pressing members 21*a* to 24*a* are formed by a low friction material, the above wear and the decreases in speed can be further suppressed.

Embodiment 2

Figure 5:
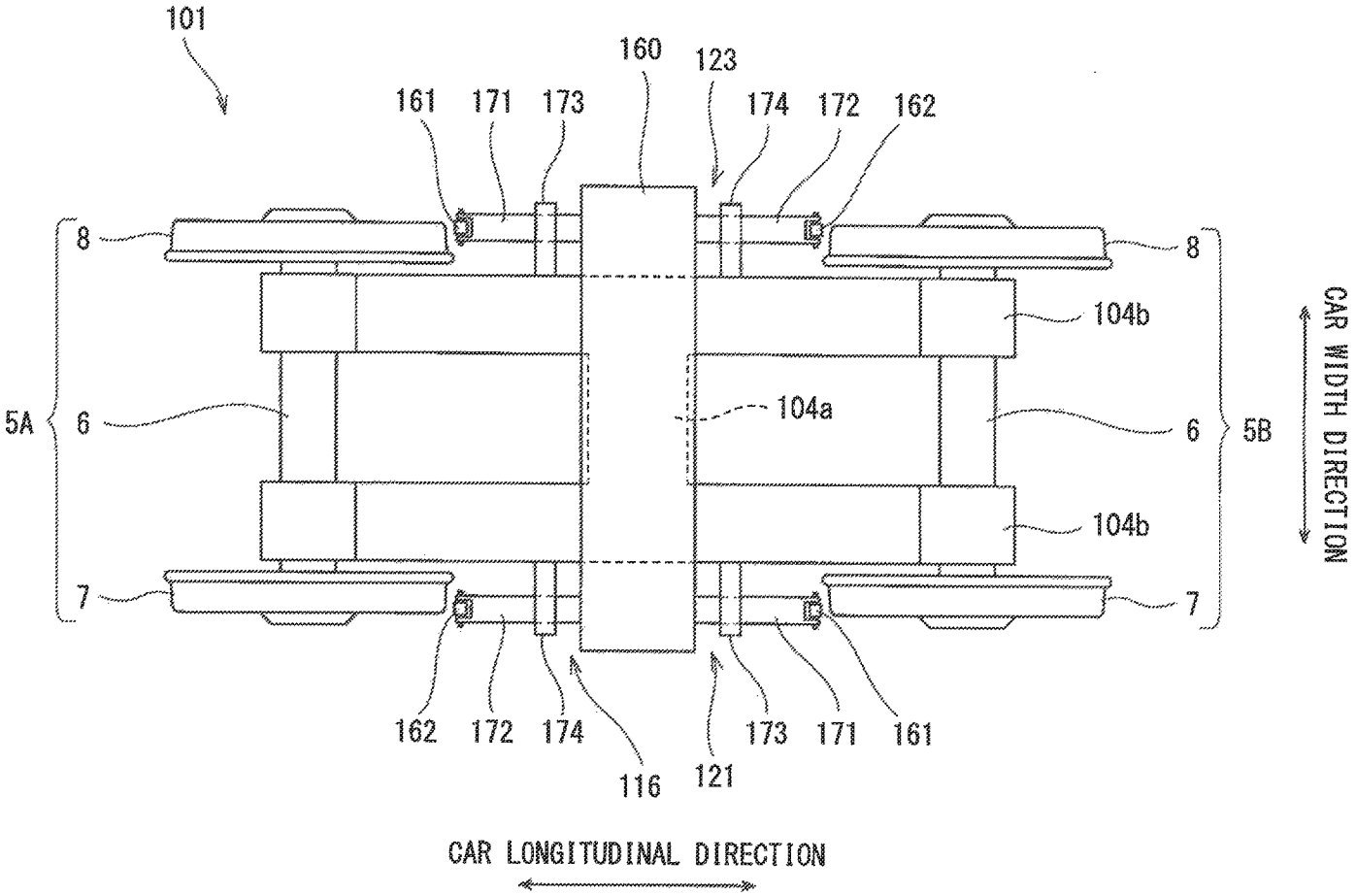
FIG. 5 is a plan view showing the steering bogie for the railcar according to Embodiment 2.
Figure 6:
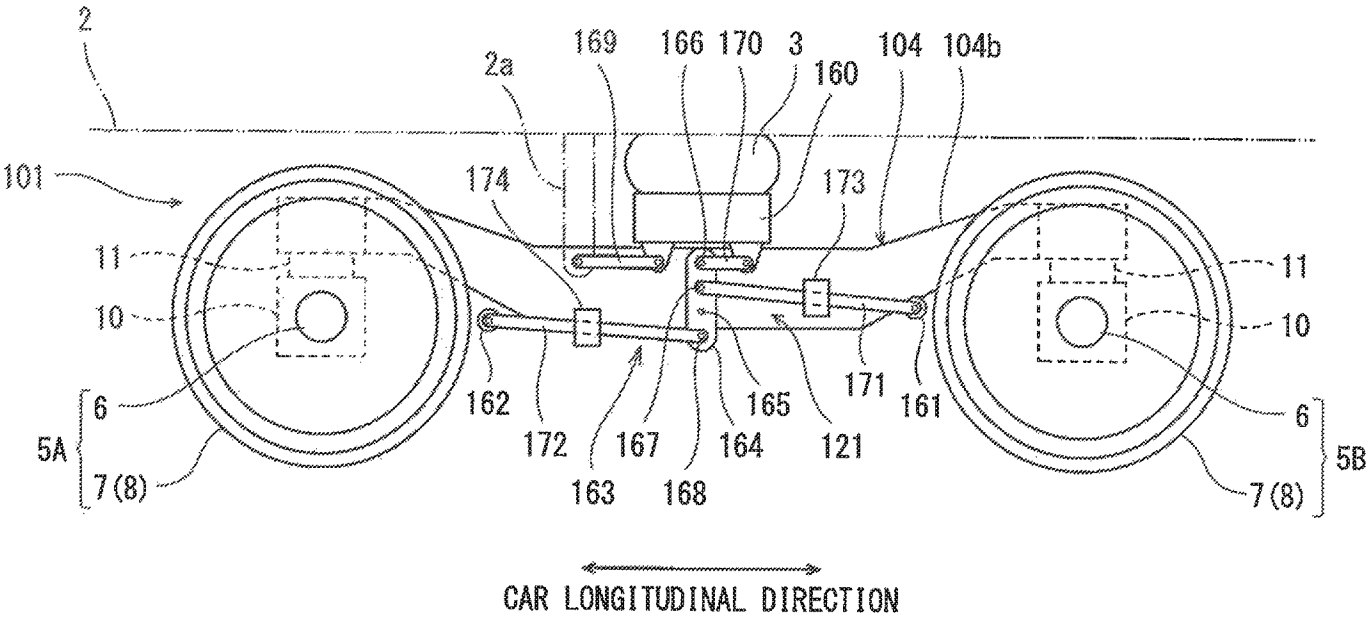
FIG. 6 is a side view showing the steering bogie of FIG. 5.

FIG. 5 is a plan view showing a steering bogie 101 for a railcar according to Embodiment 2. FIG. 6 is a side view showing the steering bogie 101 of FIG. 5. The same reference signs are used for the same components as in Embodiment 1, and detailed explanations of the same components are avoided. As shown in FIGS. 5 and 6, the steering bogie 101 of Embodiment 2 includes a bolster 160 supporting the carbody 2 through the air springs 3 and extending in the car width direction. The bolster 160 is connected to a bracket 2*a* of the carbody 2 by a bolster anchor 169. The bolster 160 is supported by a bogie frame 104 so as to be turnable relative to the bogie frame 104 in the yawing direction. The bogie frame 104 includes: a cross beam 104*a* located under the bolster 160 and extending in the car width direction; and a pair of side sills 104*b* connected to both respective car width direction end portions of the cross beam 104*a* and extending in the car longitudinal direction. The wheelset 5A extending in the car width direction is arranged in front of the cross beam 104*a*, and the wheelset 5B extending in the car width direction is arranged behind the cross beam 104*a*.

The bogie 101 is an inner frame-type bogie. Each of the axles 6 of the wheelsets 5A and 5B is located at an inner side of the first wheel 7 and the second wheel 8 in the car width direction and rotatably supported by the axle boxes 10 through the bearings. Each of the side sills 104*b* is located at an inner side of the first wheel 7 and the second wheel 8 in the car width direction and extends in the car longitudinal direction from the cross beam 104*a* to positions above the axle boxes 10. As with Embodiment 1, each of the axle boxes 10 is elastically coupled to the side sill 104*b* by the axle box suspension 11 that is the axle beam-type suspension.

A steering device 116 configured to press the first and second wheels 7 and 8 to steer a pair of wheelsets 5A and 5B with respect to the bogie frame 104 is mounted on the bogie frame 104. The steering device 116 includes: a first steering unit 121 arranged at one side in the car width direction; and a second steering unit 123 arranged at the other side in the car width direction. Since the first steering unit 121 and the second steering unit 123 are configured point-symmetrically with respect to the center of the bogie, the following will explain only the first steering unit 121.

The first steering unit 121 includes: a first pressing member 161 that can contact and separate from the first wheel 7; a second pressing member 162 that can contact and separate from the first wheel 7; and a steering link mechanism 163 (power mechanism) configured to transmit power which causes the first and second pressing members 161 and 162 to contact and separate from the first wheels 7. The steering link mechanism 163 includes a steering lever 164 arranged outside the bogie frame 104 in the car width direction. The steering lever 164 includes a fulcrum 165, a force point 166, a first action point 167, and a second action point 168. The first action point 167 is arranged at one side of the fulcrum 165, and the second action point 168 is arranged at the other side of the fulcrum 165. The steering lever 164 is supported by the bogie frame 104 so as to be turnable about an axis extending in the car width direction at the fulcrum 165. The steering lever 164 is coupled to the bolster 160 at the force point 166 through a coupling link 170.

The steering lever 164 is coupled to a longitudinal direction inner end portion of a first steering link 171 at the first action point 167. The steering lever 164 is coupled to a longitudinal direction inner end portion of a second steering link 172 at the second action point 168. The first pressing member 161 is connected to a longitudinal direction outer end portion of the first steering link 171. The second pressing member 162 is connected to a longitudinal direction outer end portion of the second steering link 172. Each of the first and second pressing members 161 and 162 faces the wheel tread of the first wheel 7 from the middle side in the car longitudinal direction. The first pressing member 161 is a roller rotatably supported by the outer end portion of the first steering link 171, and the second pressing member 162 is a roller rotatably supported by the outer end portion of the second steering link 172. Guide members 173 and 174 are provided at the bogie frame 104 and guide the first and second steering links 171 and 172, respectively. The guide member 173 restricts predetermined displacement or more of the first steering link 171 in the car width direction and supports the first steering link 171 from below such that the first steering link 171 is slidable in the longitudinal direction. The guide member 174 restricts predetermined displacement or more of the second steering link 172 in the car width direction and supports the second steering link 172 from below such that the second steering link 172 is slidable in the longitudinal direction.

According to the above configuration, when the bogie 101 passes through the curved line, the steering link mechanism 163 operates in conjunction with the turning of the bogie frame 104 relative to the bolster 160 and the carbody 2 about a vertical axis. With this, the steering lever 164 turns about the fulcrum 165 in a vertical flat plane, and this displaces the first and second pressing members 161 and 162 relative to the bogie frame 104 in the car longitudinal direction. When the first and second pressing members 161 and 162 are displaced by the steering link mechanism 163 in such directions as to get away from each other, the first and second pressing members 161 and 162 press the wheel treads of the first wheels 7 of the wheelsets 5A and 5B outward in the car longitudinal direction to steer the wheelsets 5A and 5B. In contrast, when the first and second pressing members 161 and 162 are displaced by the steering link mechanism 163 in such directions as to get close to each other, the first and second pressing members 161 and 162 separate from the wheel treads of the first wheels 7, and the wheelsets 5A and 5B return to the neutral positions.

The present invention is not limited to the above embodiments, and modifications, additions, and eliminations of the components may be made within the scope of the present invention. The above embodiments may be combined arbitrarily. For example, a part of components in one embodiment may be applied to another embodiment. Further, a part of components in an embodiment may be separated and arbitrarily extracted from the other components in the embodiment. For example, the bogie may be a bolsterless bogie or a bogie with a bolster and may be an outer frame-type bogie or an inner frame-type bogie. The axle box suspension is not limited to an axle beam-type suspension, and various types of suspensions may be used as long as wheelsets are displaceable relative to a bogie frame in a yawing direction. The pressing target member pressed by the steering device for steering the wheelset is not limited to the wheelset and may be a member (for example, an axle box or an axle beam) displaced integrally with the wheelset in the steering direction. The actuator for causing the pressing member to contact and separate from the wheel is not limited to the hydraulic cylinder and may be a pneumatic cylinder, an electric linear motor, or the like.

The pressing member is not limited to a rotatable roller and may be a slide member that slidably surface-contacts the wheelset. In this case, the slide member is formed by a low friction material that is lower in friction coefficient than at least the material of the sliding surface of the brake shoe of the brake device. The wheelset 5 may be steered in such a manner that: the first steering unit 21 pushes the wheel tread of the first wheel 7 outward in the car longitudinal direction; and the second steering unit 22 pushes the wheel tread of the second wheel 8 inward in the car longitudinal direction (to be specific, the first wheel 7 and the second wheel 8 are pushed in directions different from each other by 180°). Or, the second steering unit 22 and the fourth steering unit 24 may be omitted, the wheelset 5 may be steered in the first direction only by the first steering unit 21, and the wheelset 5 may be steered in the second direction only by the third steering unit 23. Further, only one of the wheelsets 5A and 5B may be steered.

INDUSTRIAL APPLICABILITY

As above, the steering bogie for the railcar according to the present invention has the above excellent effects, and it is useful to widely apply the present invention to railcars that can achieve the significance of these effects.

REFERENCE SIGNS LIST

1 steering bogie
2 carbody
4 bogie frame
5A, 5B wheelset (pressing target member)
6 axle
7 first wheel
8 second wheel
16, 116 steering device
21 to 24, 121, 123 first to fourth steering units
21*a* to 24*a*, 161, 162 first to fourth pressing members
21*b* to 24*b* first to fourth hydraulic cylinders (actuators; power mechanisms)
50 steering system
163 steering link mechanism (power mechanism)
100 railcar

The invention claimed is:

1. A steering bogie for a railcar,
the steering bogie comprising:
a bogie frame supporting a carbody of the railcar;
a wheelset including an axle and wheels, the axle extending in a car width direction, the wheels being provided at both respective sides of the axle; and
a steering device that presses the wheel to steer the wheelset with respect to the bogie frame,
the steering device including at least one steering unit,
the at least one steering unit including
a pressing member that separably contacts the wheel to press the wheel, and
a power mechanism that causes the pressing member to contact and separate from the wheel, wherein
the steering device steers the wheelset by the pressing member pressing the wheel by power of the power mechanism.

2. The steering bogie according to claim 1, wherein the steering device steers the wheelset by the pressing member pressing a wheel tread of the wheel by the power of the power mechanism.

3. The steering bogie according to claim 1, wherein the pressing member is a roller that is rotatable together with the wheel when the pressing member contacts the wheel.

4. The steering bogie according to claim 1, wherein the pressing member is formed by a low friction material.

5. The steering bogie according to claim 1, wherein:
the at least one steering unit comprises a plurality of steering units;
the plurality of steering units include
a first steering unit that separably presses a first portion of the pressing target member, the first portion being located at one side in the car width direction and
a second steering unit that separably presses a second portion of the pressing target member, the second portion being located at the other side in the car width direction; and
the first steering unit and the second steering unit press the pressing target member in directions different from each other to steer the wheelset.

6. A steering bogie for a railcar, the steering bogie comprising:
a bogie frame supporting a carbody of the railcar;
a wheelset including an axle and wheels, the axle extending in a car width direction, the wheels being provided at both respective sides of the axle; and
a steering device that presses a pressing target member to steer the wheelset with respect to the bogie frame, the pressing target member being constituted by the wheelset or a member configured to be displaced integrally with the wheelset in a steering direction,
the steering device including at least one steering unit,
the at least one steering unit including
a pressing member that separably contacts the pressing target member to press the pressing target member, and
an actuator that causes the pressing member to contact and separate from the pressing target member.

7. The steering bogie according to claim 1, wherein the power mechanism is a link mechanism that operates in accordance with turning of the bogie frame relative to the carbody about a vertical axis.

8. The steering bogie according to claim 6, wherein:
the pressing target member is the wheel of the wheelset; and
the steering device steers the wheelset by the pressing member pressing the wheel by power of the power mechanism.

9. The steering bogie according to claim 8, wherein the steering device steers the wheelset by the pressing member pressing a wheel tread of the wheel by the power of the power mechanism.

10. The steering bogie according to claim 8, wherein the pressing member is a roller that is rotatable together with the wheel when the pressing member contacts the wheel.

11. The steering bogie according to claim 8, wherein the pressing member is formed by a low friction material.

12. The steering bogie according to claim 6, wherein:
the at least one steering unit comprises a plurality of steering units;
the plurality of steering units include
a first steering unit that separably presses a first portion of the pressing target member, the first portion being located at one side in the car width direction and
a second steering unit that separably presses a second portion of the pressing target member, the second portion being located at the other side in the car width direction; and
the first steering unit and the second steering unit press the pressing target member in directions different from each other to steer the wheelset.

13. The steering bogie according to claim 6, wherein the actuator includes a hydraulic cylinder that causes the pressing member to contact and separate from the pressing target member.

* * * * *